US006499478B1

(12) United States Patent
Perez

(10) Patent No.: US 6,499,478 B1
(45) Date of Patent: Dec. 31, 2002

(54) APPARATUS FOR PREVENTING DAMAGE TO BOWS

(76) Inventor: Anita J. Perez, R.R.1, Box 160, Pleasant Hill, IL (US) 62366

( * ) Notice: Subject to any disclaimer, the term of this patent is extended or adjusted under 35 U.S.C. 154(b) by 0 days.

(21) Appl. No.: 09/883,726

(22) Filed: Jun. 18, 2001

(51) Int. Cl.[7] ..... F41B 5/00
(52) U.S. Cl. ..... 124/86; 124/25.6
(58) Field of Search ..... 124/23.1, 24.1, 124/25.6, 86, 88

(56) References Cited

U.S. PATENT DOCUMENTS

| | | | | | |
|---|---|---|---|---|---|
| 4,146,009 | A | * | 3/1979 | Adams | 124/88 |
| 4,261,321 | A | | 4/1981 | Nishioka | 124/67 |
| 4,605,223 | A | | 8/1986 | Rainville | 272/130 |
| 4,623,145 | A | | 11/1986 | Paraskevakos | 272/135 |
| 4,708,341 | A | | 11/1987 | Paraskevakos | 272/135 |
| 4,732,133 | A | * | 3/1988 | Chattin | 124/88 X |
| 4,911,364 | A | | 3/1990 | Irie | 239/289 |
| 5,002,035 | A | | 3/1991 | Brooks | 124/23.1 |
| 5,143,043 | A | | 9/1992 | Belsford | 124/24.1 |
| 5,297,533 | A | | 3/1994 | Cook | 124/88 |
| 5,592,928 | A | | 1/1997 | Frasier | 124/1 |
| 6,161,532 | A | | 12/2000 | Goff et al. | 124/35.2 |

* cited by examiner

*Primary Examiner*—John A. Ricci
(74) *Attorney, Agent, or Firm*—Grace J. Fishel

(57) ABSTRACT

A damping mechanism to safely allow an archer to draw and release a bow without an arrow. The bow has one or more conventional attachment mounting holes in the handle provided by a manufacturer for mounting an arrow rest, stabilizer, archery sight or some other accessory. The damping mechanism includes a damping cylinder with a piston rod attached to the bow string and a clamp for mounting the damping cylinder to the bow using one or more of the attachment mounting holes.

18 Claims, 4 Drawing Sheets

APPARATUS FOR PREVENTING DAMAGE TO BOWS

BACKGROUND OF THE INVENTION

1. Field of the Invention

The present invention relates to an apparatus for protecting bows from being broken or damaged when the bow is drawn and released without an arrow.

2. Brief Description of the Prior Art

It is common for archers to test the feel of a bow by drawing the bow without having an arrow in place and accidentally releasing the string from the full draw point, i.e., "dry firing" the bow. If the bow is a compound bow, the return of the string without the resistance of an arrow can be so rapid and with such force that the limbs, eccentrics, cables, string or riser may be damaged. Damage to the limbs is possible when the bow is a recurve bow.

There are various devices to allow archers to safely draw and release a bow without an arrow. These devices allow an archer to draw and release the bow without an arrow to build up strength or to improve technique and shooting form.

The prior art mechanisms that allow an archer to safely draw and release a bow without an arrow incorporate a damping device, such as a fluid cylinder, to slow the release of tension in the bow string by applying a resistance to the arrow. The damping device, i.e., a fluid cylinder, is attached to the bow, for example, with a bolt-and-clamp mechanism installed around the bow handle. This arrangement may damage the bow and requires removal of the arrow rest which an archer may not like if the arrow rest has been tuned.

The following patents are incorporated by reference herein: U.S. Pat. Nos. 4,261,321, 4,605,223, 4,623,145, 4,708,341, 4,911,364, 5,002,035, 5,143,043, 5,297,533, 5,592,928 and 6,161,532.

BRIEF SUMMARY OF THE INVENTION

In view of the above, it is an object of the present invention to provide a damping mechanism to permit an archer to safely draw and release a bow without an arrow that makes use of conventional threaded attachment points already present in a conventional bow. It is another object to provide a nocking structure for a damping mechanism that does not require the bow to be unstrung. Other objects and features of the invention will be in part apparent and in part pointed out hereinafter.

The present invention provides a damping mechanism to permit an archer to safely draw and release a bow without an arrow. The damping mechanism is attached to the bow at one or more attachment mounting holes in a handle or riser of the bow conventionally provided for attachment of an arrow rest, stabilizer, sight, cable guard or the like threaded insert provided by a manufacturer for an assessory. The damping mechanism includes a damping cylinder and a means for mounting the damping cylinder to the bow. The means for mounting the damping cylinder has a clamping body with a longitudinal slit with means for compressing the clamping body at the slit on the damping cylinder. A fastener is provided for connecting the clamping body to one or more of the attachment mounting holes. An arrow-like piston rod of the damping cylinder occupies the place of an arrow and is attached to the bow string. The invention may also utilize a novel nock latch for securely and releasably attaching the bow string to the piston rod.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
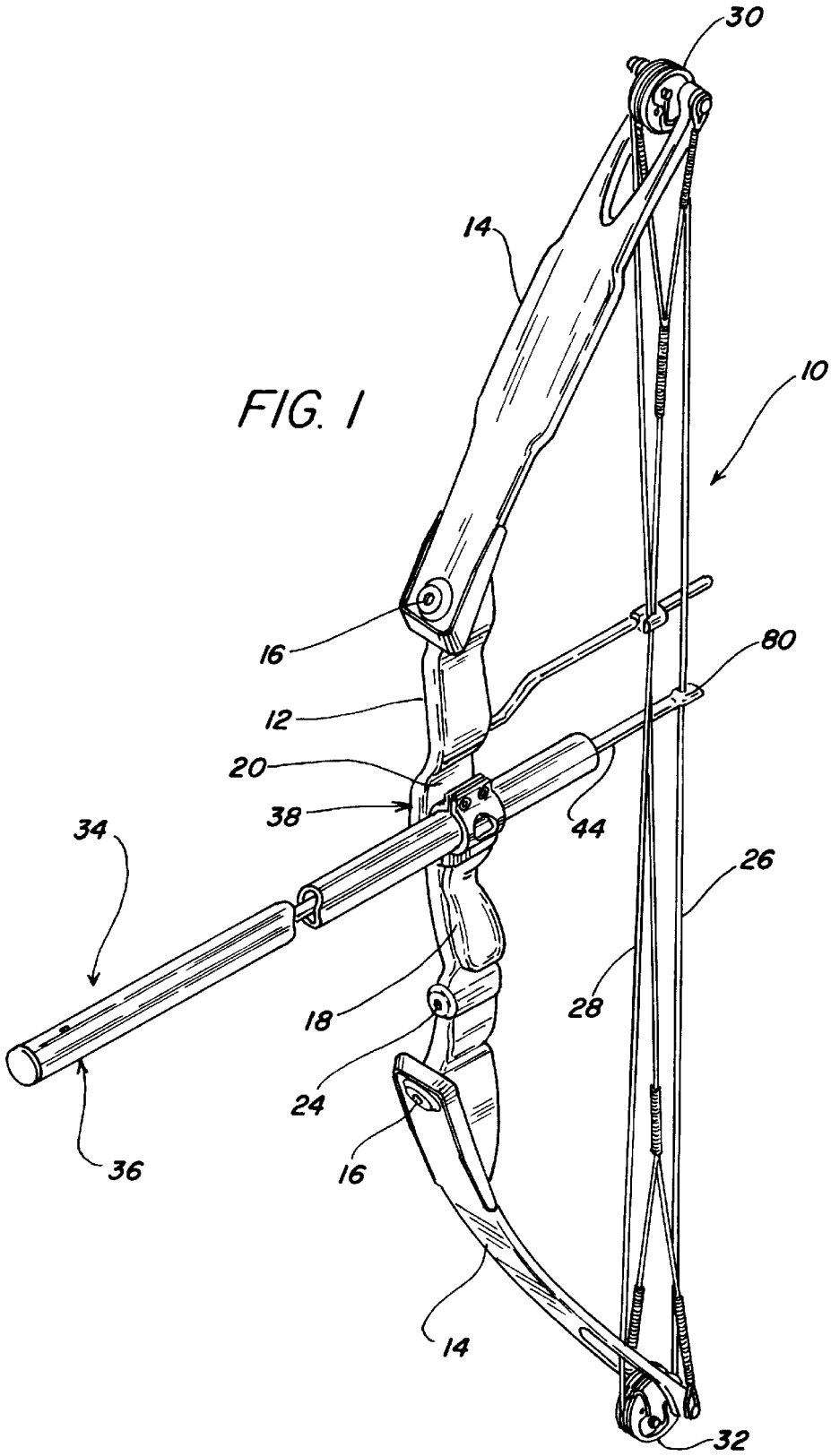
FIG. 1 is a perspective view of a compound bow having a damping mechanism in accordance with the present invention.

Referring to the drawings more particularly by reference character, FIG. 1 shows a compound bow 10 having a bow handle 12 and limbs 14. Limbs 14 are attached to handle 12 by limb bolts 16. Handle 12 includes a grip 18, a bow window 20, a conventional arrow rest mount 22 (see FIG. 2) and a conventional stabilizer mount 24. Bow 10 also has a bow string 26 attached to a cable 28. Bow string 26 passes over an idler wheel 30 and a cam 32, in a one-cam compound bow, or over both cams in a two-cam compound bow.

Figure 2:
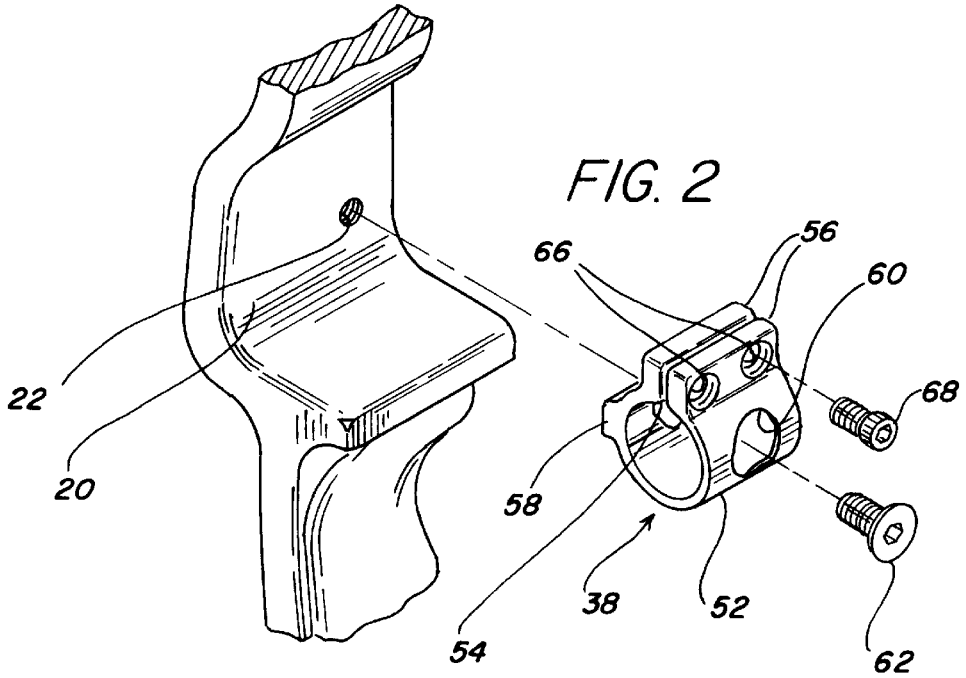
FIG. 2 is a partial exploded perspective view showing the attachment of a means for mounting a damping cylinder to the arrow rest mount on a bow.
Figure 3:
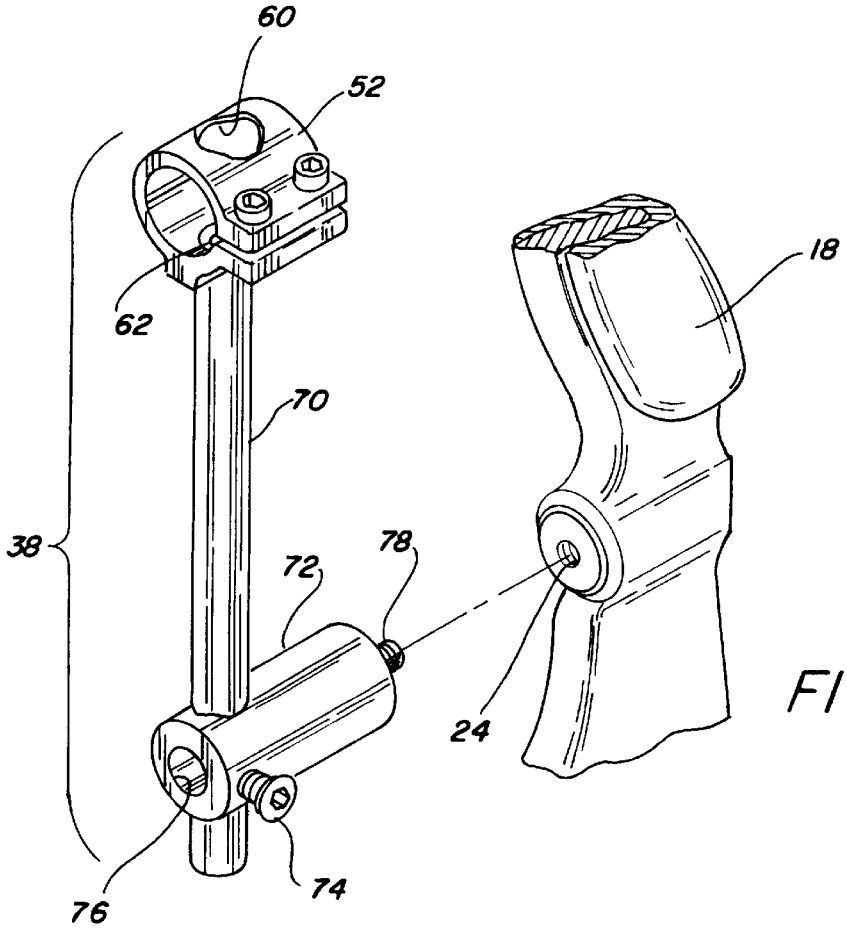
FIG. 3 is a view similar to FIG. 2 showing an alternative means for mounting a damping cylinder to the stabilizer mount on a bow.
Figure 4:
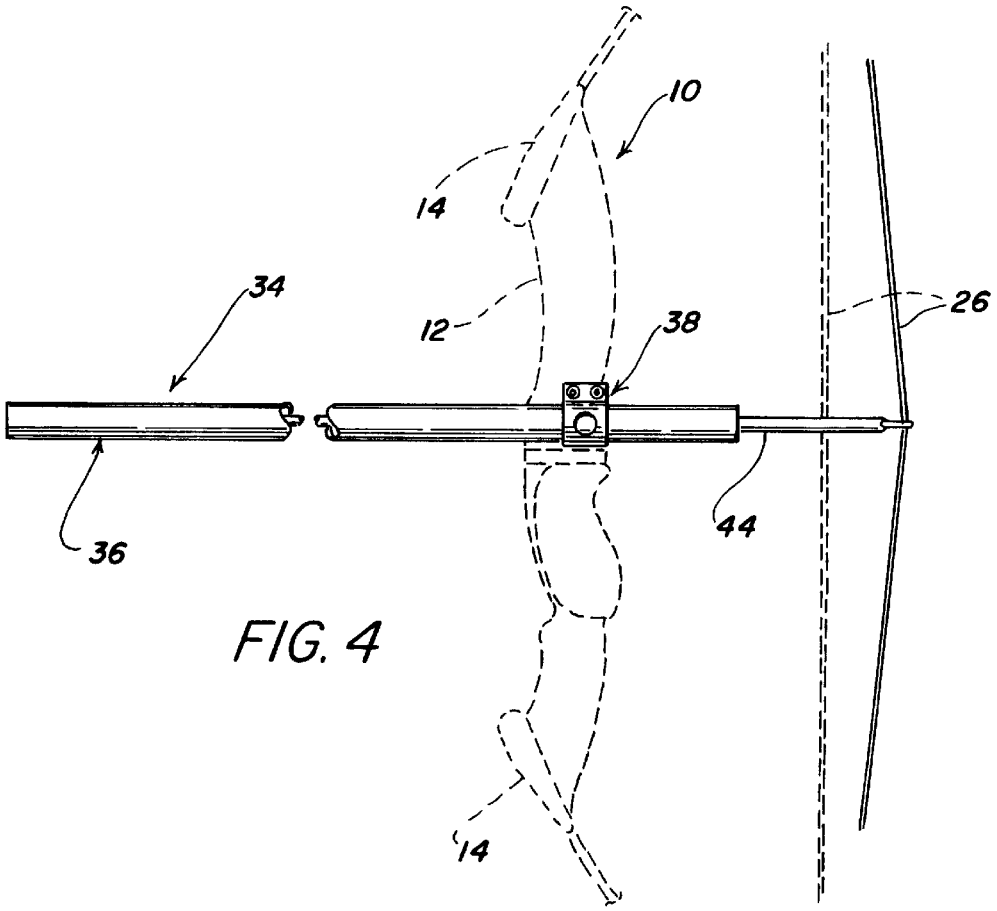
FIG. 4 is a side view of a compound bow, in phantom, showing the damping mechanism installed on the bow with the bow string drawn in full lines and with the bow string relaxed in broken lines.

A damping mechanism 34 in accordance with the present invention may be attached to bow 10 at arrow rest mount 22 as shown in FIGS. 1–2 and 4 or at stabilizer mount 24 as shown in FIG. 3. With continuing reference to FIGS. 1–2 and 4, damping mechanism 34 includes a damping cylinder 36 and a means for mounting 38 the damping cylinder.

Figure 5:
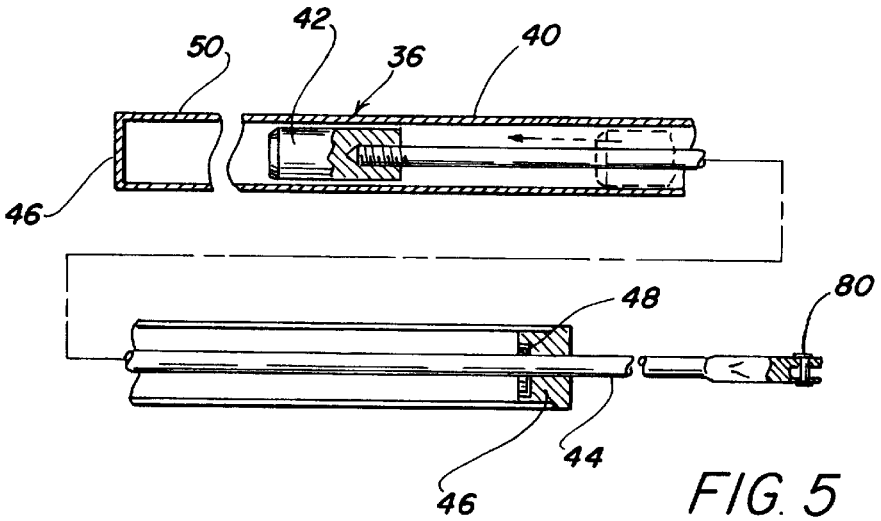
FIG. 5 is a cross-sectional view of a damping cylinder shown in FIGS. 1 and 4 and a hole through the piston rod for attaching the bow string to a piston rod of the damping cylinder; and, FIG. 6 is a detailed view of a nock latch.

As shown in FIG. 5, damping cylinder 36 includes a cylinder barrel 40 and a piston 42 with an elongated, arrow-like piston rod 44 which when used with bow 10 occupies the location which would be occupied by an arrow in normal firing of bow 10. Cylinder barrel 40 has end caps 46, one of which has a seal 48 through which piston rod 44 passes. The interior of cylinder barrel 40 is hollow and contains an elastic medium, for example a fluid such as air or other gas. Cylinder barrel 40 or piston rod 44 may have an orifice 50 therein to control the damping effect of damping cylinder 36, as is known in the art. It will be appreciated that other fluids, such as liquids may be used as well as other damping means such as friction or springs. When bow 10 is draw and released without an arrow the energy stored in the bow is absorbed in a slow controlled manner by damping cylinder 36, as will be appreciated by those skilled in the art.

Turning to FIG. 2, means for mounting 38 damping cylinder 36 has a hollow cylindrical clamp body 52. Clamp body 52 has a longitudinal slit 54 bordered with a pair of longitudinal, outwardly extending flanges 56, as shown. Clamp body 52 also has a longitudinal, outwardly extending flat 58. Flat 58 is spaced from longitudinal flanges 56 by about ninety degrees of rotation about clamp body 52, but it will be appreciated that other spacing may be used. A transverse bore 60 passes through clamp body 52 and flat 58 for receipt of a threaded fastener 62 providing means for joining clamp body 52 to bow 10. Threaded fastener 62 can be passed through bore 60 and then seated in flat 58 for use as described below.

Hollow clamp body 52, providing means for receiving damping cylinder 36, is sized to snugly receive damping cylinder 36, as shown in FIG. 1. Longitudinal flanges 56 have one or more pairs of vertically aligned bores 66 extending therethrough. One of bores 66 in each pair may be threaded to receive a threaded fastener 68. By tightening threaded fasteners 68 in the threaded one of bores 66, clamp body 52 constricts on cylinder barrel 40 by pinching slit 54 partially closed, securely attaching damping cylinder 36 to bow 10. Other means for constricting clamp body 52 at slit 54 will occur those skilled in the art, such as by passing a bolt through aligned bores 66 and attaching a nut. As the nut is tightened on the bolt, flanges 56 may be pressed together.

As shown in FIG. 3, clamp body 52 may be attached to bow 10 at arrow rest mount 22, at stabilizer mount 24 or at some other analogous threaded opening conventionally provided on bow handle 12. When means for mounting 38 damping cylinder 36 is attached to arrow rest mount 22, flat 58 of clamp body 52 is held in abutment against bow window 20 and fastener 62 passed through transverse bore 60 for threaded engagement with arrow rest mount 22.

When means for mounting 38 the damping cylinder is attached to stabilizer mount 24, clamp body 52 is attached to a rod 70, one end of which is tapped for threaded engagement with fastener 62. Rod 70 passes in close sliding fashion through a hollow mounting block 72. Mounting block 72 can be held in a selected position on rod 70 with a set screw 74 threaded through mounting block 72 for engagement with rod 70. A bore 76 is provided through mounting block 72 transverse to rod 70 for receipt of a threaded fastener 78. Threaded fastener 78 may be similar to threaded fastener 62 used for mounting clamp body 52 to rod 70. To mount damping cylinder 36 through stabilizer mount 24, clamp body 52 is attached to rod 70 with fastener 62 and rod 70 removed from mounting block 72. Mounting block 72 is held in abutment against grip 18 and fastener 78 passed through bore 76 for threaded engagement with stabilizer mount 24. After mounting block 72 is secured to stabilizer mount 24, rod 70 is inserted into mounting block 72 and clamp body 52 positioned vertically such that damping cylinder 36 is in bow window 20. Rod 70 is then locked in mounting block 72 with set screw 74. If an archer does not want to remove a previously installed arrow rest (not shown) because it has been sighted in, damping cylinder 36 may be positioned above the arrow rest and piston rod 44 nocked high.

Figure 6:
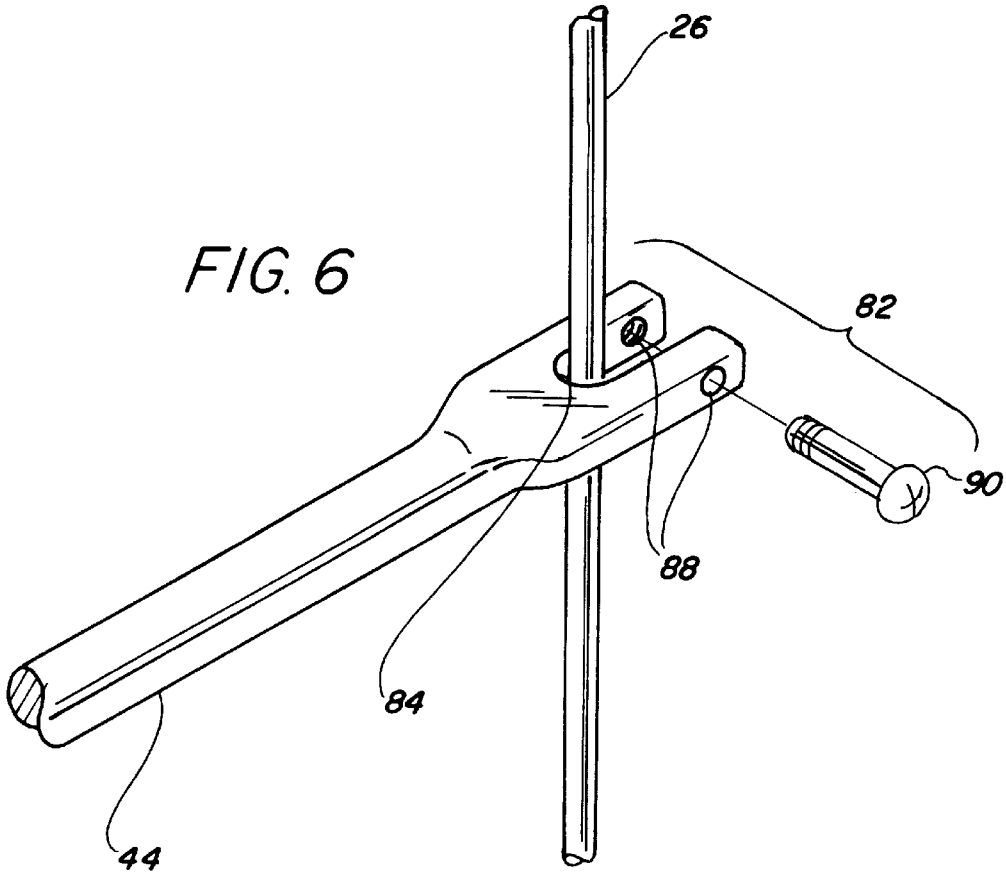

As shown in FIGS. 1 and 5, bow string 26 of bow 10 may be received in piston rod 44 by passing bow string 26 through a transverse hole 80 provided therefor. However, this means for connecting the piston rod to the bow string, requires bow 10 to be unstrung so that an end of bow string 26 can be passed through hole 80. It is preferred that a nock latch 82, a representative one of which is shown in FIG. 6, be provided at the end of piston rod 44 for securing piston rod 44 to bow string 26. As shown, piston rod 44 is bifurcated to form a nock 84. Arms 86 of nock 84 have transverse, aligned bores 88, at least one of which is threaded and through which a threaded fastener 90 passes. Bow string 26 is trapped between threaded fastener 90 and the base of nock 84 to securely connect piston rod 44 to bow string 26. Nock latch 82 may take other forms, such as a clasp, etc., may be padded to prevent damage to bow string 26 and may be used with damping mechanisms not in accordance with the present invention. Such other mechanisms are discussed in the "Brief Summary of the Invention" section above and shown in the prior art references cited by the applicant to the U.S. Patent and Trademark Office.

In view of the above, it will be seen that damping cylinder 36 is mounted to bow 10 with means for mounting 38 without injuring the bow by making use of mounts already provided on a convention bow for other attachments, e.g., arrow rest mount 22, stabilizer mount 24, etc. It will also be seen that the other objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A damping mechanism to allow an archer to safely draw and release a bow without an arrow, the bow having one or more attachment mounting holes in a handle of the bow, said damping mechanism comprising a damping cylinder and a means for mounting the damping cylinder to the bow, said means for mounting having a clamping body with a longitudinal slit, means for compressing the clamping body at the slit on the damping cylinder and a fastener for connecting the clamping body to an attachment mounting hole.

2. The damping mechanism of claim 1 wherein the longitudinal slit is bordered with outwardly extending, longitudinal flanges.

3. The damping mechanism of claim 2 wherein the longitudinally extending flanges have a flange fastener for pinching the flanges together thereby compressing the clamping body at the slit.

4. The damping mechanism of claim 3 wherein the flange fastener is received in a bore passing though the longitudinally extending flanges.

5. The damping mechanism of claim 1 wherein the longitudinal slit is bordered with outwardly extending, longitudinal flanges and the clamping body has a flat on an outer surface.

6. The damping mechanism of claim 5 wherein the clamping body has a transverse bore through the body and extending through the flat.

7. The damping mechanism of claim 6 wherein the fastener is received in the transverse bore through the clamping body and is seated in the flat, the transverse bore providing access to the fastener for attaching the clamping body to an attachment mounting hole on the bow.

8. The damping mechanism of claim 1 wherein the damping cylinder has a piston rod, the piston rod having an end connectable to a bow string, the end of the piston rod having a nock and a nock latch to trap a bow string in the nock.

9. The damping mechanism of claim 8 wherein the damping cylinder is an air cylinder.

10. The damping mechanism of claim 1 wherein the means for mounting further include a rod, a mounting block and a second fastener, said clamp body mounted on the rod with the first fastener, said rod slidingly received in a the mounting block and the mounting block attached to an attachment mounting hole with the second fastener.

11. A damping mechanism to allow an archer to safely draw and release a bow without an arrow, the bow having one or more attachment mounting holes in a handle of the bow, said damping mechanism comprising a damping cylinder and a means for mounting the damping cylinder to the bow, the damping cylinder having an arrow-like piston rod and the piston rod having an end which is connectable to a bow string, the means for mounting having a hollow clamp body, the damping cylinder being receivable in the hollow interior of the clamp body, the clamp body having a longitudinal slit therein, the slit extending through the clamp body and communicating with the interior of the clamp body, the clamp body having two longitudinally extending flanges, the flanges bordering the slit and extending outwardly from the clamp body, the flanges having transverse bores therethrough receiving a flange fastener, the flange fastener constricting the clamp body on the damping cylinder, the clamp body having a further fastener to join the clamp body to an attachment mounting hole in a bow.

12. The damping mechanism of claim 11 wherein the piston rod terminates with a bifurcated nock and a nock latch joins the bifurcations of the nock to trap the bow string in the nock.

13. The damping mechanism of claim 11 wherein the clamping body has a transverse bore passing through the clamping body and receiving a fastener therethrough.

14. The damping mechanism of claim 13 wherein the clamp body has a longitudinally extending flat with the transverse bore passing through the flat.

15. The damping mechanism of claim 11 wherein the means for mounting further include a rod, a mounting block and a second fastener, said clamp body mounted on the rod with the first fastener, said rod slidingly received in the mounting block and the mounting block attached to an attachment mounting hole with the second fastener.

16. A damping mechanism to allow an archer to safely draw and release a bow without an arrow, the bow having one or more attachment mounting holes in a handle of the bow, said damping mechanism comprising a damping cylinder and means for mounting the damping cylinder to a bow, the damping cylinder having an arrow-like piston rod and the piston rod having an end, the end including means for connecting the piston rod to a bow string, the means for mounting including a substantially cylindrical clamp body having a hollow interior, the hollow interior providing means for receiving the damping cylinder in the cylindrical body, the cylindrical body having means for constricting the cylindrical body about the damping cylinder to fix the damping cylinder therein, the device having means for joining the cylindrical body to a bow.

17. The damping mechanism of claim 16 wherein the piston rod terminates in a bifurcated nock and the means for connecting the piston rod to the bow string is a nock latch joining the bifurcations of the nock to trap the bow string in the nock.

18. The damping mechanism of claim 16 wherein the nock latch is padded to, prevent damage to the bow string.

* * * * *